US006523919B1

(12) United States Patent
Israelsen et al.

(10) Patent No.: US 6,523,919 B1
(45) Date of Patent: Feb. 25, 2003

(54) FILING CABINET HAVING VERTICALLY EXTENSIBLE DRAWERS

(75) Inventors: L. Dwight Israelsen, North Logan, UT (US); R. Burns Israelsen, Bountiful, UT (US)

(73) Assignee: Switchboard, North Logan, UT (US)

( * ) Notice: Subject to any disclaimer, the term of this patent is extended or adjusted under 35 U.S.C. 154(b) by 0 days.

(21) Appl. No.: 09/620,853

(22) Filed: Jul. 21, 2000

Related U.S. Application Data

(60) Provisional application No. 60/144,748, filed on Jul. 21, 1999.

(51) Int. Cl.[7] ..... A47B 50/00
(52) U.S. Cl. ..... 312/310; 312/319.8
(58) Field of Search ..... 312/310, 309, 312/312, 319.8, 301, 298; 108/147

(56) References Cited

U.S. PATENT DOCUMENTS

| | | | | |
|---|---|---|---|---|
| 1,990,300 A | | 2/1935 | Miller | 109/1 |
| 2,495,046 A | | 1/1950 | Wolters | 187/9 |
| 2,738,251 A | | 3/1956 | Corum | 312/312 |
| 2,812,226 A | | 11/1957 | Wolters | 312/272.5 |
| 3,361,510 A | | 1/1968 | McDermott | 312/312 |
| 4,150,860 A | | 4/1979 | Ducasse | 312/184 |
| 4,871,218 A | | 10/1989 | Swinson | 312/312 |
| 5,115,822 A | | 5/1992 | Nichols | 134/135 |
| 5,437,236 A | * | 8/1995 | Zeiner | 108/147 |
| 5,586,816 A | * | 12/1996 | Geiss, II | 312/301 |

FOREIGN PATENT DOCUMENTS

| | | | | |
|---|---|---|---|---|
| GB | 715455 | * | 9/1954 | 312/310 |

* cited by examiner

*Primary Examiner*—Lanna Mai
*Assistant Examiner*—Jerry A. Anderson
(74) *Attorney, Agent, or Firm*—Workman, Nydegger & Seeley

(57) ABSTRACT

A filing cabinet has at least one drawer or file hangers associated with the drawer that can be selectively lifted from a first elevation to a second elevation when the drawer has been moved to an open position with respect to the frame of the filing cabinet. The filing cabinet includes the frame; drawers, including the drawer that can be lifted; and a drawer-opening assembly that movably connects the drawer to the frame. When the drawer is opened, it can be disengaged from the drawer-opening assembly and lifted to a position that is more accessible to users of the filing cabinet. The drawer can be lifted by force supplied by the user, by mechanical or electrical devices, or by a combination of the foregoing. Examples of the mechanical or electrical devices include pneumatic pistons, hydraulic pistons, spring-activated structures, and electric motors. The bottom drawer or a number of bottom drawers of the filing cabinet can experience the lifting motion. Lifting the drawers in this manner makes the drawers more accessible and reduces the physical strain that can be associated with use of conventional filing cabinets.

8 Claims, 9 Drawing Sheets

FILING CABINET HAVING VERTICALLY EXTENSIBLE DRAWERS

RELATED APPLICATION

This application claims the benefit of U.S. Provisional Patent Application Ser. No. 60/144,748, entitled "Filing Cabinet Having Vertically Extensible Drawers", filed Jul. 21, 1999, which is incorporated herein by reference.

BACKGROUND OF THE INVENTION

1. The Field of the Invention

The present invention relates to filing cabinets and other structures or devices having drawers for storing objects therein. More particularly, the present invention relates to filing cabinets having one or more drawers and/or file hangers that, when opened, can be raised to an elevation that enables easy access to the contents of the drawers.

2. The Prior State of the Art

Filing cabinets have been used for years to organize and store documents, papers and the like. Other similar devices have been constructed for storing other objects. A typical conventional filing cabinet has several drawers movably connected to a frame, with the drawers being arranged vertically with respect to one another. FIGS. 1 and 2 illustrate a filing cabinet 10 from the prior art. The frame 12 is generally enclosed on the top, back, sides, and sometimes, bottom, with a housing. The drawers 14 slide laterally forward from the frame 12 and housing to expose the contents, while sliding back into the frame when not being accessed by a user. Filing cabinets can have any number of drawers, and typically have between two and six drawers or more.

Most filing cabinets that are intended to be used to store files and documents are configured in one of two general ways. The primary distinction between the two types of filing cabinets, namely lateral cabinets and vertical cabinets, is the alignment of files and documents that are received and stored in the drawers thereof.

As shown in FIG. 1, the drawers 14 of lateral, or horizontal, filing cabinets have a depth that is sufficient to receive files 16 and documents 18, with the length, L, of the documents 18 being aligned with the depth dimension, D, of the drawers. Usually, but not always, lateral filing cabinets, such as that illustrated in FIG. 1, have drawers 14 that have a width dimension. W, greater than a height dimension, H, when viewed from the front of the filing cabinet 10.

As shown in FIG. 2, the drawers 14' of vertical filing cabinets 10' have a width dimension, W, that is sufficient to receive files 16 and documents 18, with the length, L, of the documents being aligned with the width dimension, W, of the drawers. Usually, but not always, vertical filing cabinets have drawers 14' with a depth dimension, D, that is greater than the width dimension, W, when viewed from the front of the filing cabinet 10'.

Lateral filing cabinets 10 have the advantage of requiring the drawers 14 to be opened a distance that is generally less than that required of vertical cabinets 10'. In particular, if files 16 or documents 18 stored in lateral filing cabinets 10 have a length of 12 inches, the drawers 14 need to be opened a distance of slightly more than 12 inches to provide clearance for the files 16 or documents 18. This feature often allows lateral filing cabinets 10 to be somewhat more stable than their vertical counterparts, since the center of mass does not shift laterally when a drawer 14 is opened to the same extent that it would shift in a vertical filing cabinet 10'.

Vertical filing cabinets 10' have an advantage of generally requiring less wall space when placed in a room. As shown in FIG. 2, the width. W, of drawers 14' of vertical filing cabinet 10' needs to be at most several inches wider than the length, L, of the files 16 or documents 18 that are stored therein.

Filing cabinet users have often experienced inconvenience and physical stress when accessing the bottom drawer or drawers of a filing cabinet. As can be appreciated, conventional filing cabinets have lower drawers that can be accessed only by the user kneeling on the floor or bending uncomfortably low. However, for space and economic reasons, it is desirable to use lower drawers to store files, documents, and other items. In view of the foregoing, it would be an advancement in the art to provide filing cabinets or other similar devices that enable users to conveniently access lower drawers without having to kneel or otherwise experience the physical stress that has so often accompanied filing cabinet use.

SUMMARY AND OBJECTS OF THE INVENTION

The present invention relates to filing cabinets having at least one drawer, or a file hanger included in a drawer, that can be selectively lifted from a first elevation to a second elevation when the drawer has been moved to an open position with respect to the frame of the filing cabinet. The filing cabinet includes the frame; drawers, including the drawer that can be lifted; and a drawer-opening assembly that movably connects the drawer to the frame. Conventional filing cabinets can be modified and retrofitted to exhibit the features of the invention disclosed herein.

When the drawer is opened, it can be disengaged from the drawer-opening assembly and lifted to a position that is more accessible to users of the filing cabinet. The drawer can be lifted by force supplied by the user, by mechanical or electrical devices, or by a combination of the foregoing. Examples of the mechanical or electrical devices include pneumatic pistons, hydraulic pistons, spring-activated structures, and electric motors. Pneumatic pistons and spring-activated structures have the advantage of being self-contained force-generating devices that do not require any external energy supply. Hydraulic pistons and electric motors have the advantage of being capable of supplying a variable amount of force that might be needed to lift the drawer.

The bottom drawer or a number of bottom drawers of the filing cabinet can experience the lifting motion. One advantage of the present invention is reduction of physical stress on those who use filing cabinets or any other piece of furniture or structure in which the invention is implemented. There are several benefits that result from lifting filing cabinet drawers according to the invention. For instance, a user of a filing cabinet constructed according to the invention is able to more easily view the objects in the drawers. The user can also more conveniently locate and retrieve desired objects from the drawers or place objects into the drawers. Moreover, because drawers can be lifted to a more suitable elevation with respect to the floor, heavy objects can be more easily lifted to and from the drawers.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The invention is described below by using diagrams to illustrate either the structure or processing of embodiments used to implement the systems and methods of the present invention. Using the diagrams in this manner to present the invention should not be construed as limiting of its scope. The invention is described herein in the context of filing cabinets. However, the inventors have recognized that the principles disclosed herein are also applicable to other structures having drawers, and the invention is specifically intended to extend to such other structures.

A. Drawer Configurations

Figure 3:
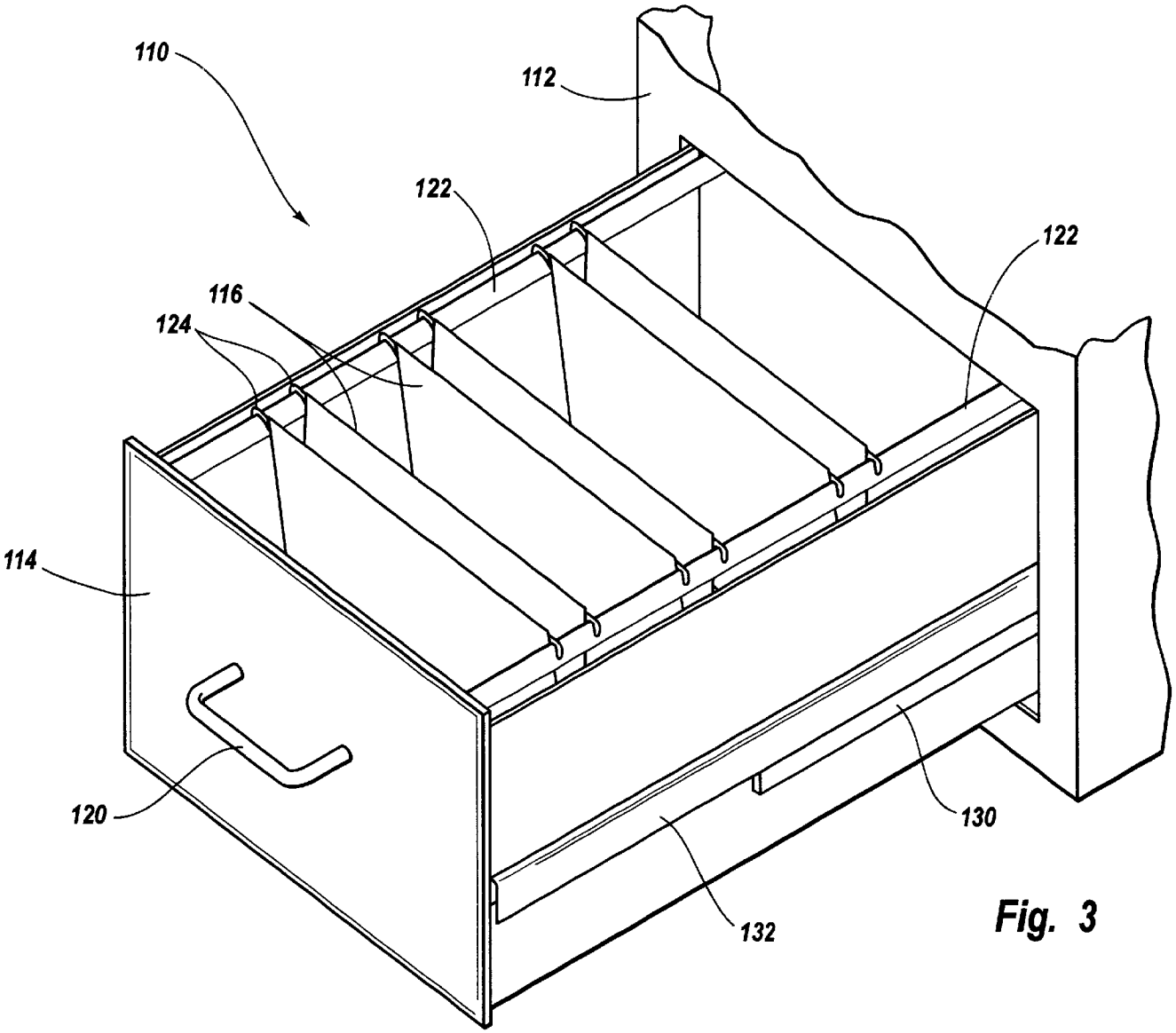
FIG. 3 is a perspective view of a drawer of a filing cabinet constructed according to the invention and adjacent portions of the drawer-opening assembly and frame of the filing cabinet.

FIG. 3 illustrates an exemplary embodiment of a filing cabinet drawer 114 adapted or constructed according to the principles of the invention. The drawer 114 can include substantially any desired conventional feature, such as a handle 120, a locking mechanism for locking drawer 114 in a closed position relative to frame 112, etc. The drawer 114 has file hangers 122 that are positioned one next to another, in the case of the vertical filing cabinet of FIG. 3, along the depth, D, of drawer 114. Files 116 hang from file hangers 122 by means of hooks 124 or other similar structures on files 116 that lie on top of and engage file hangers 122.

Lateral filing cabinets have drawers with file hangers that are positioned one next to another along the width of the drawers. Files similarly hang from the file hangers in vertical filing cabinets by means of hooks or the like. In both lateral and vertical filing cabinets, files or documents without hooks can generally be stored as well.

Drawers are opened and closed by one of two general techniques. First, drawers 114 can be slidably engaged with frame 122 of filing cabinet 110. In this case, frame 112 includes at least one track or groove on either side of the drawer. The drawer includes a corresponding runner or sliding member that engages the track or groove on the frame to securely hold the drawer in a manner that prevents side-to-side motion thereof. As the drawer is withdrawn from or moved into the frame, the runner slides along the track. Alternatively, the track or groove can be formed on the drawer, while the frame includes the corresponding runner.

Second, either frame 112 or drawer 114 can include wheels, rollers or bearings that provide a rolling engagement between the drawer and frame. In this configuration, frame 112 can include a track on each side of drawer 114 that receives a corresponding wheel or roller attached to the drawer. Such rolling action can reduce the force needed to open and close drawers. Alternatively, the wheels can be attached to frame 112, while drawers 114 include corresponding tracks.

In both the sliding and rolling configurations, filing cabinet 114 can include a telescoping assembly for opening drawers that includes one or more telescoping tracks, rollers, or other structures that are movably attached to both the frame and the drawer. This telescoping action allows drawer 114 to be opened a greater distance than might otherwise be possible or convenient, and can be particularly useful in vertical filing cabinets that have a large depth dimension. In addition, a telescoping drawer-opening assembly conveniently allows the drawer to completely clear the front face of the frame when drawer 114 is opened, thereby enabling the drawer to be lifted without interfering with the frame.

Figure 1:
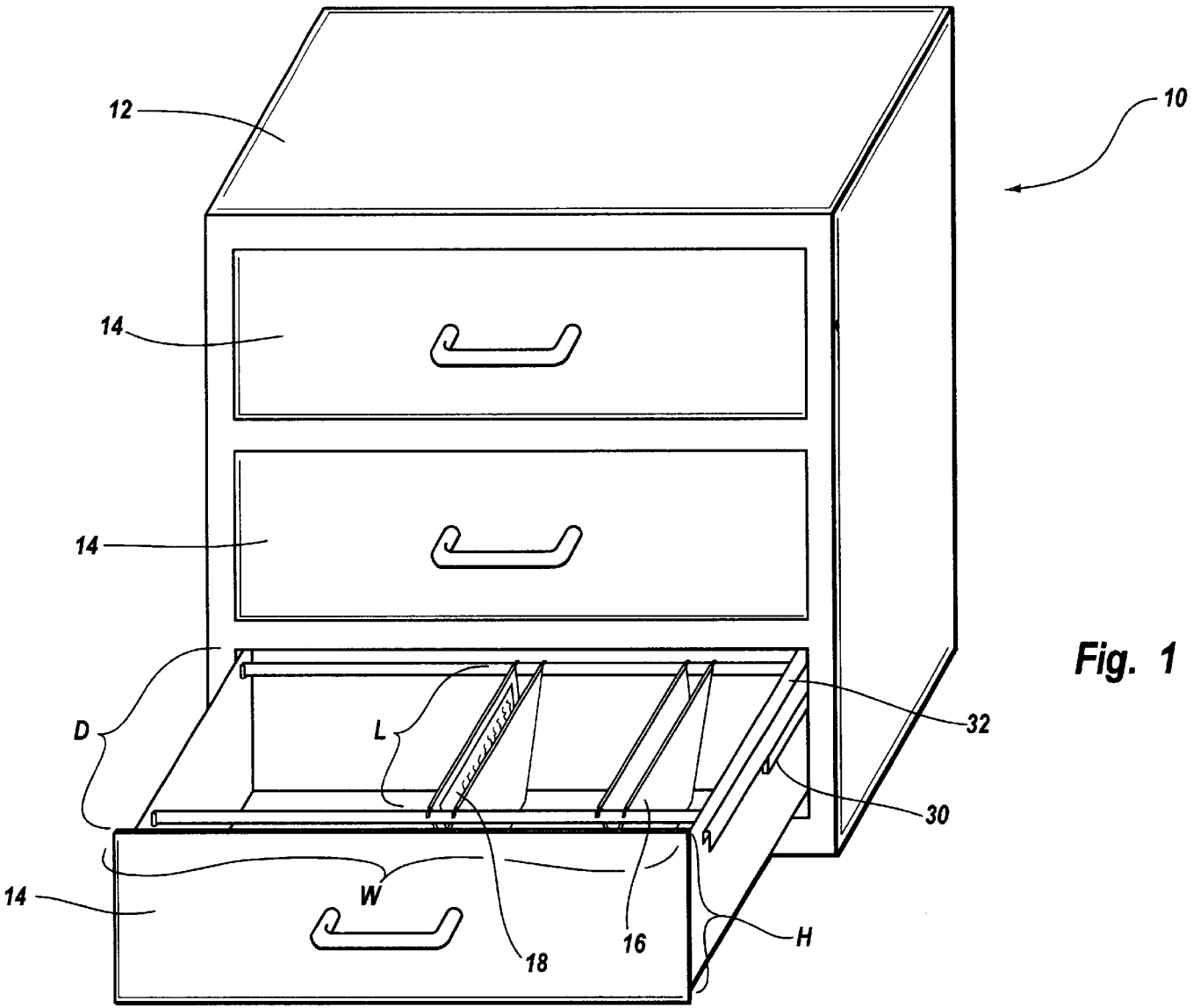
FIG. 1 is a perspective view illustrating a lateral filing cabinet.
Figure 2:
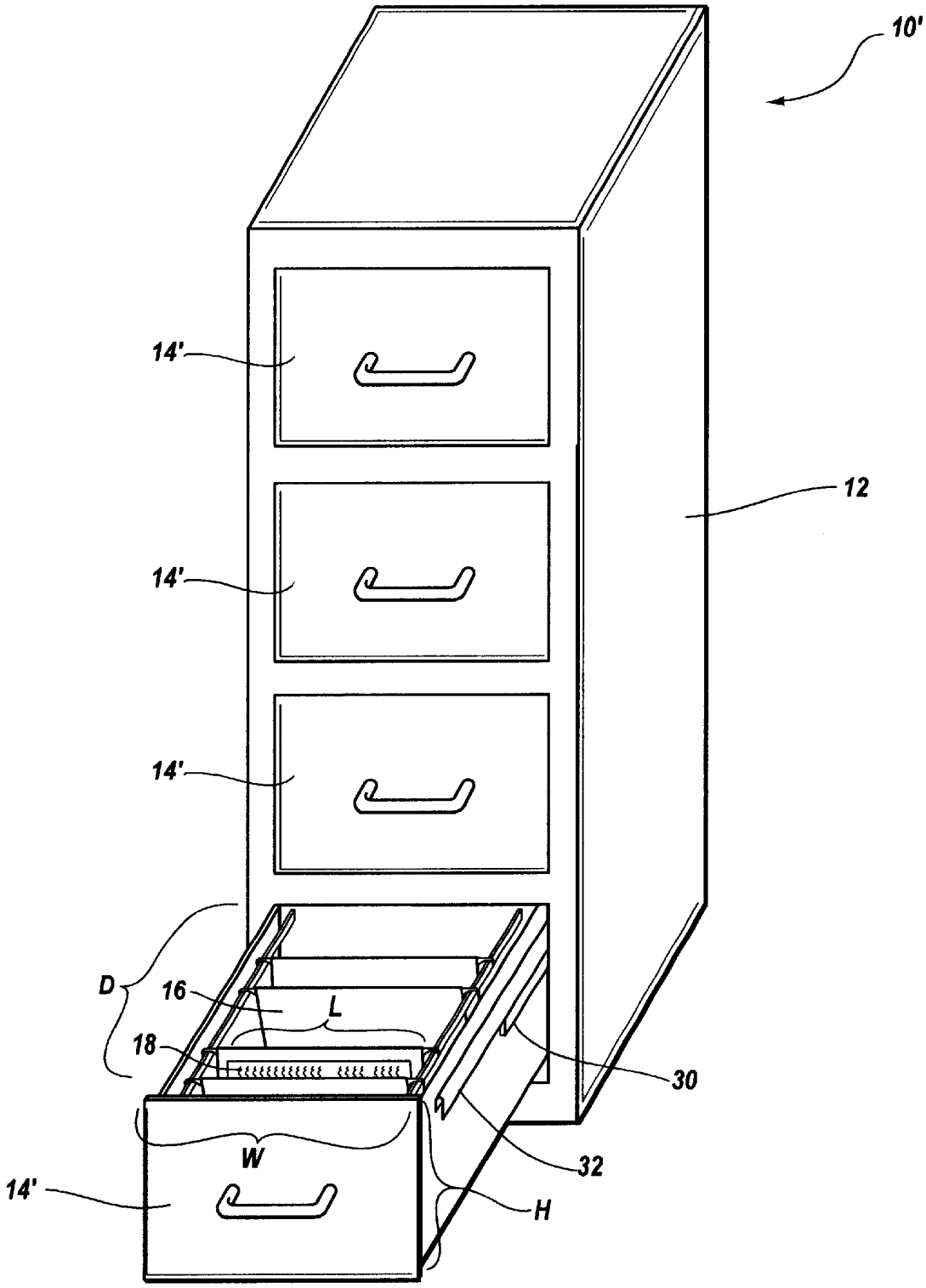
FIG. 2 is a perspective view depicting a vertical filing cabinet.

FIGS. 1 and 2 illustrate a telescoping drawer-opening assembly 30 having a channel 32 formed on each side of the drawer. FIG. 3 illustrates a telescoping drawer-opening assembly 130 and a channel 132 formed on the sides of drawer 114 to receive the drawer-opening assembly.

Many types of structures for movably connecting the drawer and the frame are possible, both in the sliding and rolling configurations. As a further example, the drawer and the frame can include mating rails that slide or roll one along the other. The present invention can be adapted to operate with substantially any means for movably connecting the drawer with the frame, several examples of which have been disclosed herein.

In any of the foregoing drawer and frame configurations, the structures that enable drawers to be opened, other than any component that is permanently or integrally attached to the drawer, is referred to as a drawer-opening assembly. Thus, the drawer-opening assembly can include any track, runner, wheel, groove, or telescoping structure.

Figure 4:
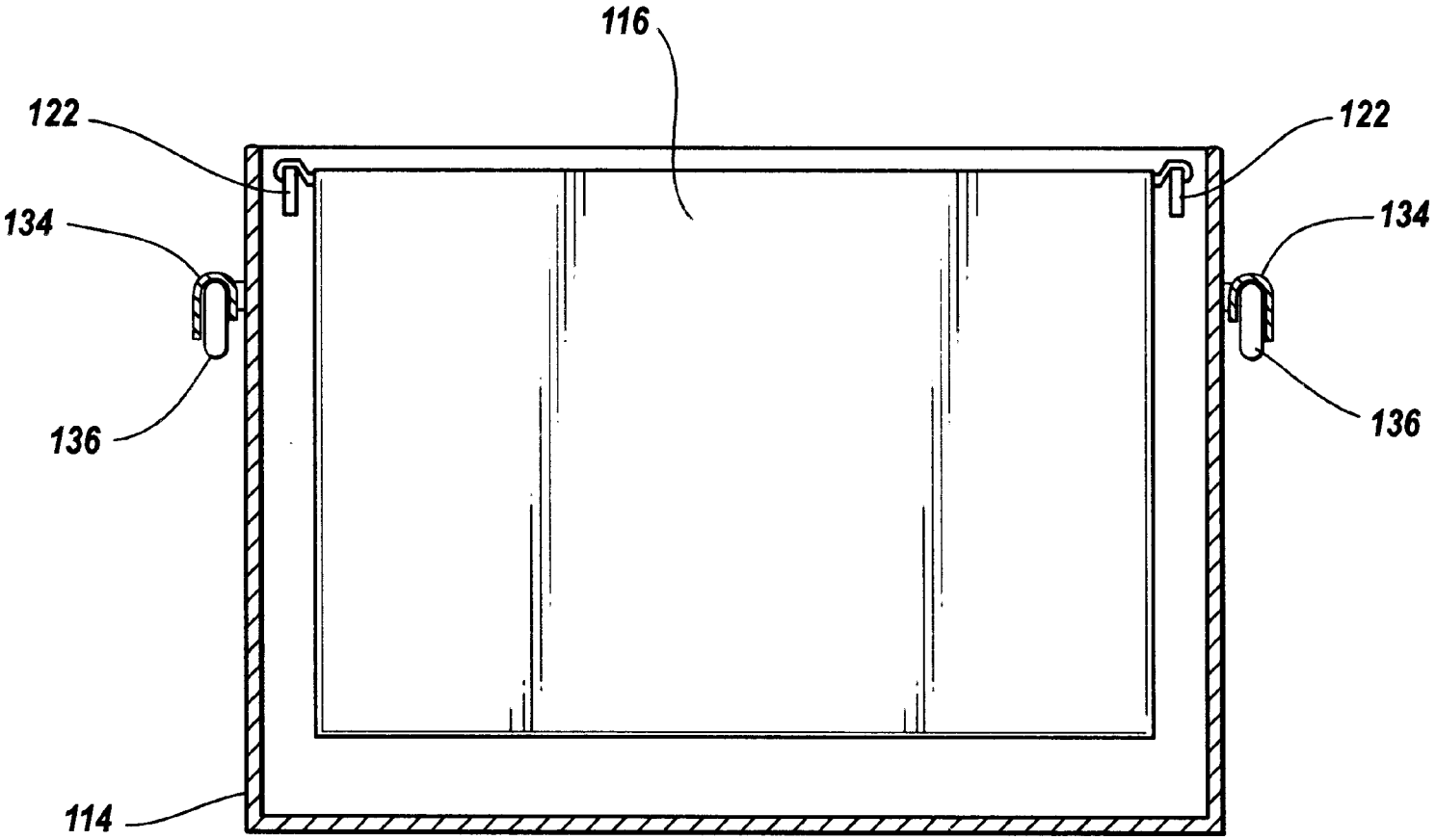
FIG. 4 is an cross-sectional elevation view of a drawer that opens with the assistance of a drawer-opening assembly.

FIG. 4 illustrates in cross-section a portion of a drawer-opening assembly and the associated structure attached to the drawer according to one embodiment of the invention. Each side of drawer 114 has an inverted "U"-shaped channel 134 that slides along a corresponding rail 136 on the frame. The rails or the drawer-opening assembly can also include locking mechanisms to temporarily lock the drawer in an open or closed position.

B. Vertical Extensibility of Drawers or Contents of Drawers

Figure 5A:
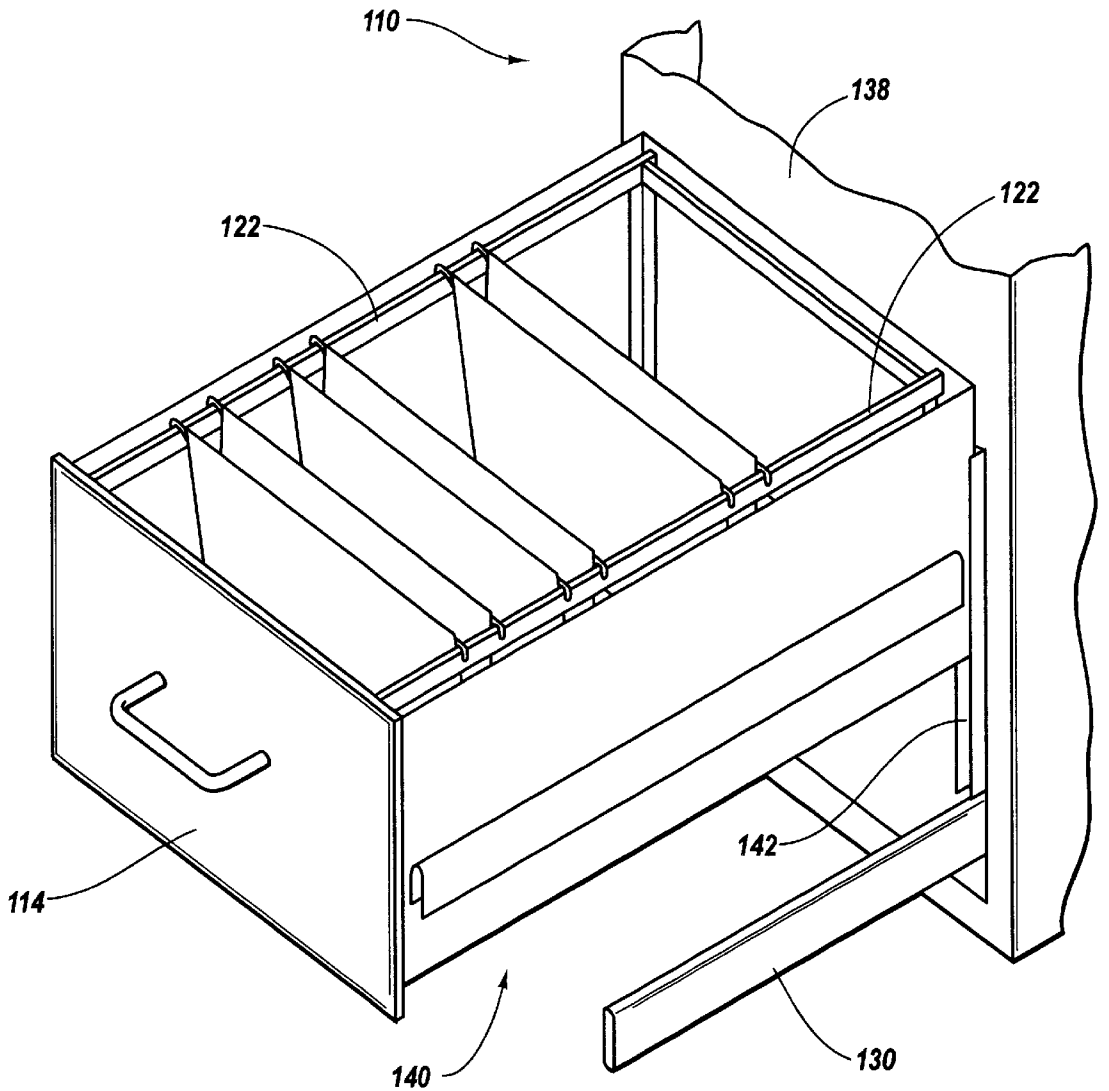
FIG. 5*a* is a perspective view illustrating a drawer that has been lifted according to an embodiment of the invention.
Figure 5B:
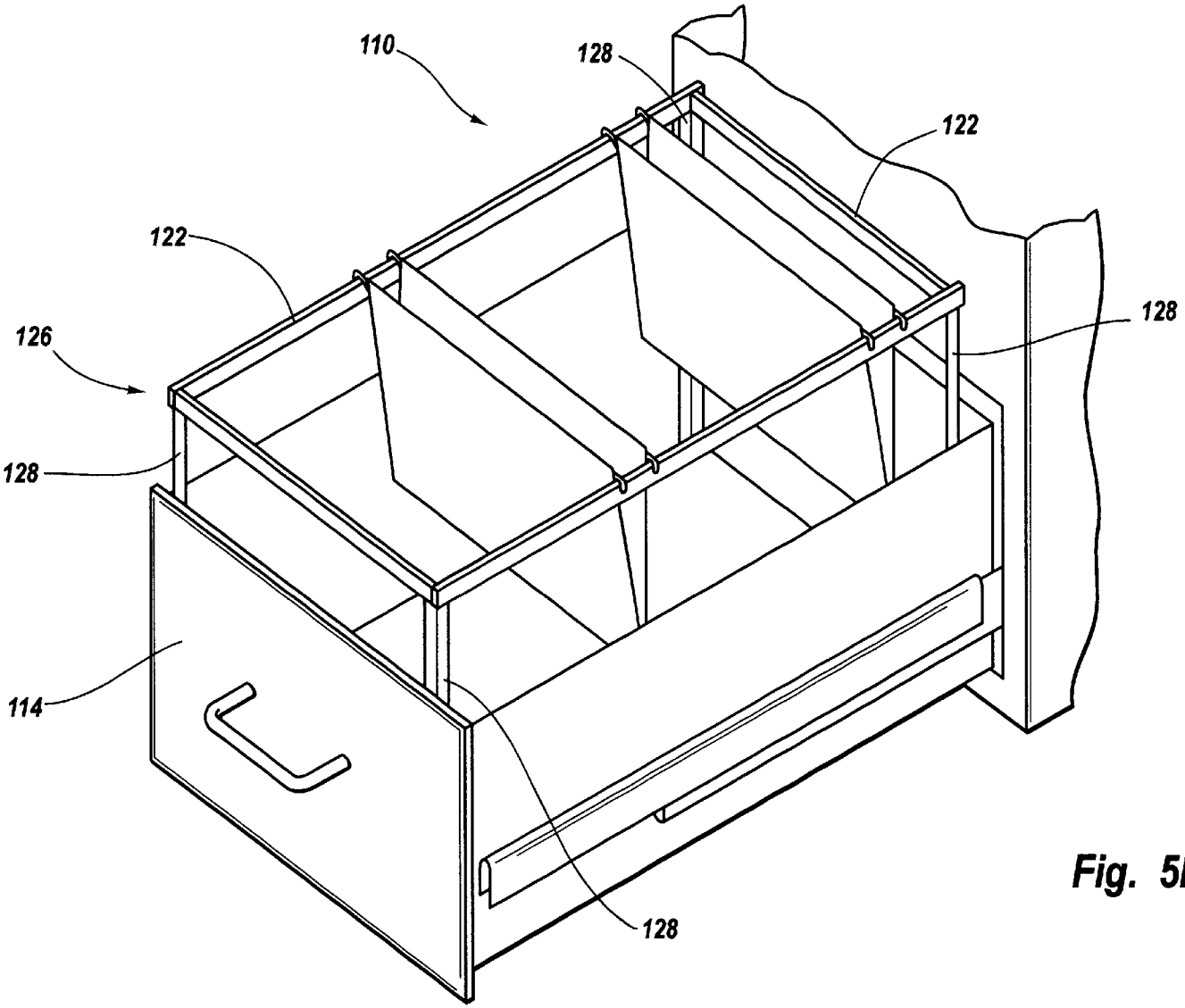
FIG. 5*b* is a perspective view showing a file hanger that has been lifted from a drawer according to an embodiment of the invention.

The bottom one or several drawers or the contents of these drawers are can be vertically adjusted according to the invention. One example of the vertical extensibility according to the invention is illustrated in FIGS. 5*a* and 5*b* in the context of a vertical filing cabinet. FIGS. 5*a* and 5*b* depict the vertical motion of either the drawer or a file hanger, rather than illustrating the mechanical structures that provide the energy and force necessary to lift the drawer or file hanger. Specific examples of and general principles relating to the means for lifting the drawers are disclosed in detail below. For purposes of FIGS. 5*a* and 5*b*, however, any of the means for lifting the drawer can generally be used.

According to one embodiment of the invention, drawer 114 is opened far enough so that that both file hangers 122 clear the front surface 138 of the filing cabinet 110. Once drawer 114 is opened, the entire drawer assembly or only a portion thereof can be lifted. For example, as shown in FIG. 5*a*, drawer 114 can be disengaged from drawer-opening assembly 130. Once drawer 114 is disengaged from drawer-opening assembly 130, the entire drawer 114, including the file hangers 122 and a basket 140 included in the drawer can be lifted.

When the entire drawer 114 is lifted, means for constraining the drawer to substantially vertical motion prevents the drawer from moving from side to side. In FIG. 5*a*, the means for constraining the drawer are illustrated as vertical rails 142. These rails 142 can alternatively be positioned at another location with respect to drawer 114. Any other suitable structures can be used as means for constraining the drawer to substantially vertical motion.

FIG. 5*b* illustrates another embodiment of the invention, in which drawer 114 remains engaged with drawer-opening assembly 130 and the file hangers 122 can be disengaged from the remainder of the drawer and lifted to raise the contents of the drawer. In this embodiment, file hangers 122 on either side of drawer 114 are connected in an integral unit 126. Hereinafter, the file hanger assembly, whether comprising two separate file hangers, two file hangers 122 joined in an integral unit 126, or two file hangers otherwise constructed, is referred to as "file hangers". When the file hangers are lifted independently from drawer 114 as shown in FIG. 5*b*, it can be useful to mechanically connect the two file hangers and/or to constrain the file hangers substantially only vertical motion. Both features are illustrated in FIG. 5*b*. In particular, as mentioned above, file hangers 122 are joined in an integral unit in FIG. 5*b*. Furthermore, file hangers 122 are equipped with vertical members 128 that guide the file hangers when they are lifted.

Figure 6A:
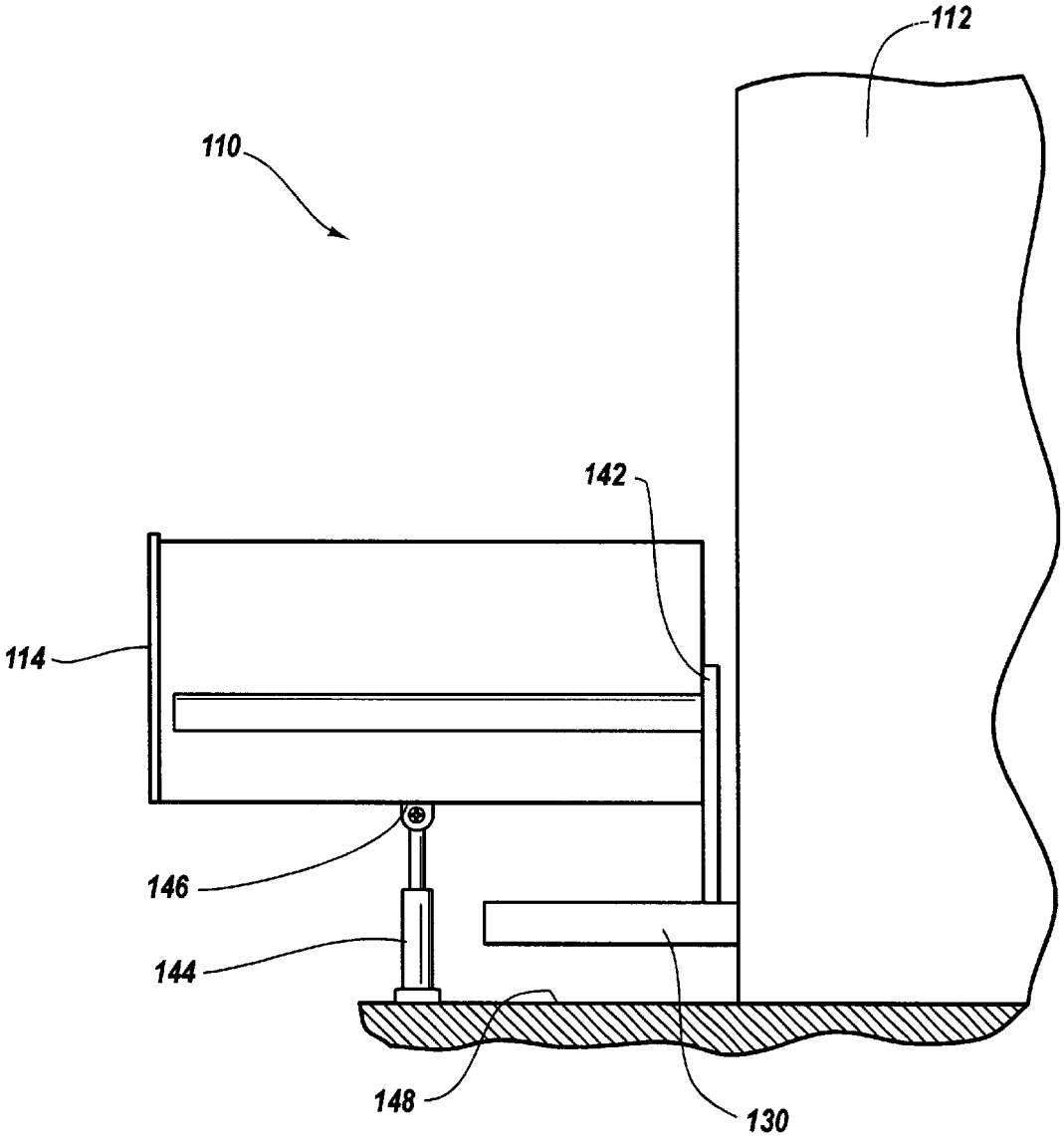
FIG. 6*a* is a side elevation view illustrating a pneumatic piston lifting a drawer according to an embodiment of the invention.

Much of the remainder of this document discusses various techniques for lifting the drawer or file hangers and examples of the means for lifting. While some of the following examples are presented in the context of lifting either the drawer or the file hangers, the following discussion is generally applicable to either embodiment. For instance, while FIG. 6*a* illustrates a pneumatic piston lifting an entire drawer, the related discussion should be understood as equally applicable to lifting file hangers. Furthermore, references to considerations that are relevant for lifting a drawer are also generally applicable to lifting file hangers.

A general term that encompasses lifting either the drawer or the file hanger is "lifting the contents of the drawer," since lifting either the drawer or the file hanger inherently lifts the contents of the drawer, as well. Similarly, a general term that encompasses either or both the means for lifting a drawer and the means for lifting a file hanger is "means for lifting contents of the drawer." It is also noted that, in view of the wide variety of disclosed structures that correspond to means for lifting, the inventors have recognized that any of a variety of other structures can suitably lift drawers or file hangers, and that other such structures are within the scope of the term "means for lifting".

It can be advantageous, when preparing to lift a drawer, to prevent other drawers from being opened, particularly drawers that are superior with respect to the drawer being lifted. As used herein "superior" refers to a drawer that is positioned higher than or above another drawer. Some conventional filing cabinets, for purposes of stability, allow only one drawer out at a time to be open. The others have to be locked shut or completely closed before a selected drawer can be opened, resulting in no more than one drawer being opened at a time. If desired, this feature of conventional filing cabinets can be adapted to the present invention. For example, it may not be desirable to begin to lift a bottom drawer while the immediately superior drawer is partially open. While this feature can be beneficial, it is not critical to the invention.

Referring again to FIG. 5*a*, when a user desires to cause a drawer to be lifted, the drawer is opened while superior drawers are closed. If desired, the other drawers, or at least the superior drawers can be manually or automatically locked in a closed position. The drawer is then lifted off the rail of the drawer-opening assembly that has guided the drawer to its open position. The rails or other components of the drawer-opening assembly can be adapted to facilitate the drawer from being released or engaged with the drawer-opening assembly.

C. Mechanisms for Lifting Drawers

Any one of a number of means for lifting a drawer or a file hanger can be used with the invention. Examples of the means for lifting include pneumatic pistons, hydraulic pistons, electric motors, and spring-activated structures, to name just a few. While the invention can be advantageously practiced using one of the foregoing mechanical means for lifting, the invention also extends to other mechanical systems for performing the work required to lift the drawer. The means for lifting can also be characterized as means for lifting the drawer or the file hanger from a first elevation to a second, higher elevation, and can further be characterized as means for lowering the drawer from the second elevation to the first elevation. The first elevation can be described as the vertical position of the drawer when the drawer is being opened and closed with respect to the frame. The second, higher elevation is any elevation to which the drawer is lifted by the means for lifting.

In any of the foregoing examples of mechanical means for lifting, all or only part of the force required to lift the drawer can be supplied by mechanical means for lifting the drawer. In situations where only part of the force is mechanically supplied, the remainder can be physically provided by a user. Sometimes, the weight of the drawer and the contents thereof will determine whether all of the force required to lift the drawer is mechanically supplied, or whether the user must do some of the lifting.

In yet another embodiment, all of the force required to lift the drawer is provided by the user, with the structure of the filing cabinet constraining the drawer to only vertical motion and temporarily locking the drawer in a lifted position when it has been raised to the desired position.

The means for lifting the drawer can use any of at least three types of energy, namely, potential energy, user-supplied energy, and external energy. The term "potential energy" is used herein according to its commonly-accepted definition. Examples of potential energy include the energy stored in springs, compressed pneumatic fluid, and weights that have been lifted to an elevation higher than a baseline elevation. "User-supplied" energy includes energy physically applied by a user to the drawer or filing cabinet. "External energy" refers to electrical or mechanical energy other than potential energy and user-supplied energy. External energy is typically provided by an external energy supply, examples of which include electrical motors and sources of hydraulic or pneumatic pressure.

1. Pneumatics

FIG. 6*a* illustrates a pneumatic piston 144 that can be used to lift or to assist in lifting drawer 114. The pneumatic piston 144 can be positioned in at least one of two locations to provide force for lifting the drawer. First, one end of the piston can be attached to the drawer while the other end is attached to the drawer-opening assembly from which the drawer is disengaged before being lifted. Second, as illustrated in FIG. 6*a*, one end of piston 144 can be attached to the bottom 146 of drawer 114, while the other end of the piston extends until it abuts the floor 148 or another surface on which filing cabinet 110 rests. The second option is particularly useful for bottom drawers. The second option can also add to the stability of the filing cabinet due to the fact that piston 144 bears part of the weight of filing cabinet 110 and rests on the floor 148.

Piston 144 can be pivotally attached to drawer 114 so as to have a generally horizontal alignment when drawer 114 is opened and closed and a generally vertical alignment, as shown in FIG. 6*a*, when drawer 114 is lifted and lowered. The horizontal alignment allows piston 144 to clear frame 112 when drawer 114 is opened and closed.

When drawer 114 is to be raised, piston 144 is positioned with its free end on floor 148. The piston is then automatically or manually actuated to provide the lifting force on drawer 114. Rails 142 or any other suitable examples of means for constraining drawer 114 to substantially vertical motion guide drawer 114 as it is raised. At its desired elevation, drawer 114 is locked in place so as to enable the user to safely access the contents of the drawer. When drawer 114 is to be lowered, it is unlocked and is returned to the lower elevation, during which time, piston 144 provides a resistive force to prevent free fall of the drawer.

One advantage of pneumatic pistons 144 is that they generally use potential energy, possibly in combination with user-supplied energy, rather than using external energy. The drawer 114 can be equipped with one or any larger number of pneumatic pistons 144, as needed. The pistons 144 should have an effective extensible length that is sufficient to lift drawer 114 to the desired elevation. They should also be capable of exerting a desired force, either singly or in combination with other pneumatic pistons, with other mechanical means for lifting, or with a user of filing cabinet 110.

Relatively inexpensive pneumatic pistons that can be used as disclosed herein are widely commercially available. Many such pneumatic piston are manufactured with a pneumatic charge that causes a resistive, outward force when the piston is compressed. Many such pneumatic pistons are capable of maintaining this pneumatic charge for an extended period of time, which can be a desirable characteristic for pneumatic pistons used according to the invention.

While self-contained, charged pneumatic pistons have often have certain benefits and are relatively simple to use and maintain, the invention can be practiced with pneumatic systems that use an external energy supply to pressurize or depressurize pneumatic fluid that is made available to the pneumatic pistons.

When drawer 114 is disengaged from drawer-opening assembly 130 or upon actuation of the one or more pneumatic pistons, which may be automatic or in response to a user action, piston 144 exerts a force on the drawer that tends to lift it. When drawer 144 is lifted to its desired position, it can be locked in position to prevent if from dropping. Any suitable locking structure that corresponds to means for locking drawer 114 in a raised position can be used, examples of which include latches, mechanically interlocking structures, and the like. When drawer 114 is to be returned to its previous elevation, it is unlocked and lowered. The pneumatic pistons further function to prevent a free fall of the drawer when it is unlocked and lowered. Depending on the force exerted by the pistons, there may need to be some user assistance when lowering the drawer, either by providing additional downward or upward force.

In one optional embodiment, drawer 114 is equipped with multiple pneumatic pistons, any one or more of which are selectively used to lift the drawer according to the weight of the drawer. In this optional embodiment, a weight sensor can be included in the filing cabinet to detect the weight of the drawer and its contents. Based on the sensed weight, an appropriate number of pneumatic pistons are used to lift the drawer. For example, consider a drawer equipped with six pneumatic pistons, each capable of exerting five pounds of force when fully compressed. If the weight sensor detects a force of ten pounds associated with the weight of the drawer, two of the pistons can be activated to lift the drawer. Similarly, if the weight sensor detects a force of thirty or more pounds, all six pistons can be activated. The filing cabinet according to this embodiment can include a processor programmed to calculate the number of pistons to be used based on the weight and to engage the calculated number of pistons according to techniques that will be understood by those skilled in the art upon learning of the invention disclosed herein.

Selective activation of pistons according to this optional embodiment can include allowing the selected pistons to exert a force between the drawer and, for example, the rails of the drawer-opening assembly. The non-selected pistons are locked in a compressed position and are uncoupled from, for example, either the drawer or the rails of the drawer-opening assembly.

2. Hydraulics

Hydraulic pistons can be used in filing cabinet 110 to raise and lower drawer 114 in a manner very similar to that described above in reference to pneumatic pistons. One difference is that the hydraulic pistons generally require some external energy supply to pressurize the hydraulic fluid. While hydraulic systems typically entail greater complexity than pneumatic systems, they have the advantage of supplying the appropriate amount of force to lift the drawers, essentially regardless of the weight of the drawers. Suitable hydraulic equipment is readily commercially available, and those skilled in the art, upon learning of the disclosure made herein, will understand the necessary details of the hydraulic equipment to be used.

3. Electric Motors

Figure 6B:
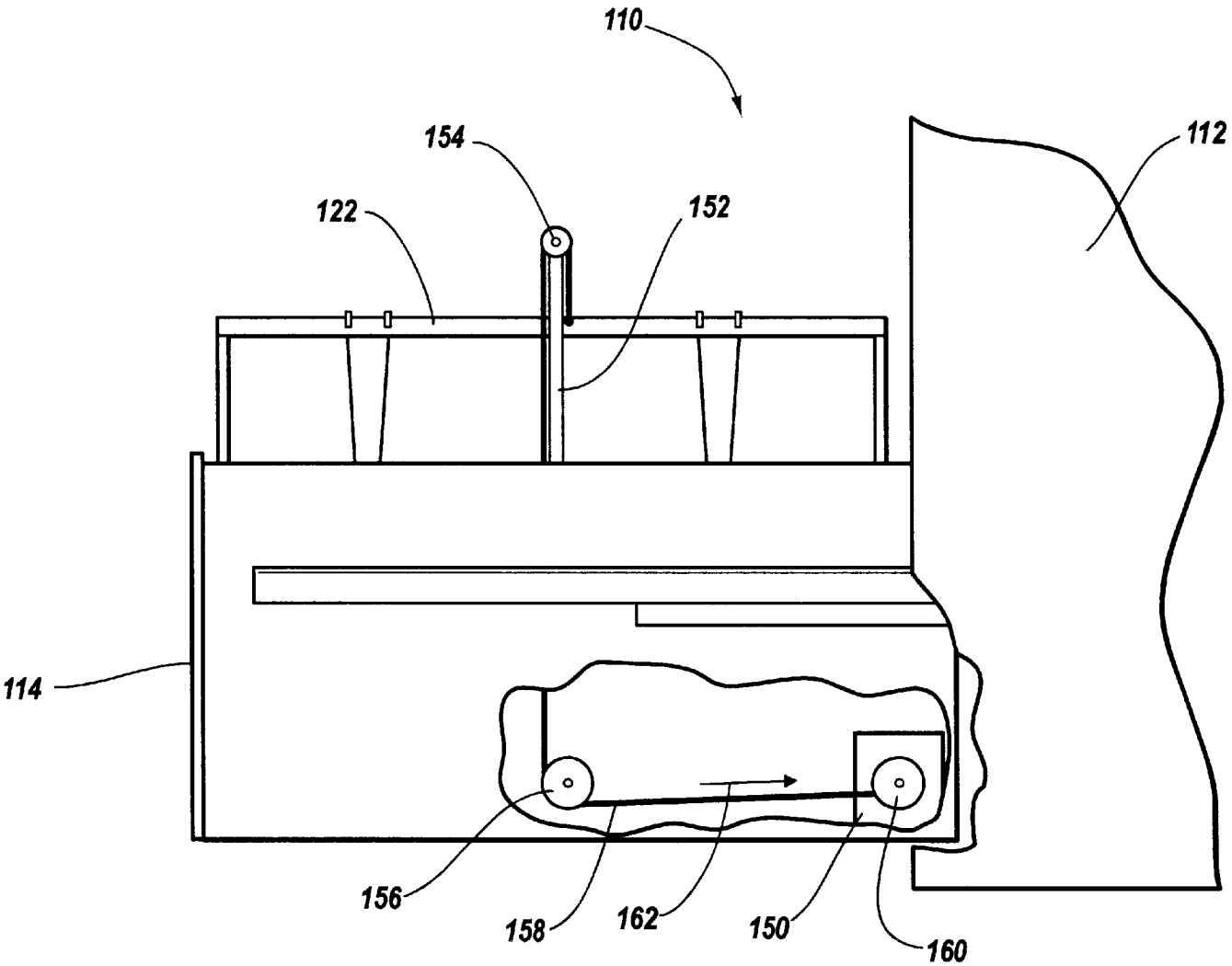
FIG. 6*b* is a cut-away side elevation view depicting an electric motor lifting a file hanger according to an embodiment of the invention.

In yet another embodiment, one or more electric motors are used to supply the force to lift the drawers and to slowly lower the drawers. FIG. 6*b* illustrates one example of a system whereby an electric motor can lift a drawer of a filing cabinet. There are a multitude of ways of coupling an electric motor with a drawer or file hangers to provide lifting motion, any of which are within the scope of the invention. For example, the electric motor is coupled to the drawer by means of gears, chains, or other mechanical structures that can convert rotational motion of a shaft of the electric motor to vertical motion of the drawer.

Electric motors, while representing an external source of energy that introduces some complexity to the system, has the advantage of supplying the appropriate amount of force to the drawer to raise or lower the drawer without user assistance, regardless of the weight of the drawer, within reasonable limits.

Unlike typical pneumatic or hydraulic cylinders, the distance by which a drawer can be lifted using an electric motor is not limited to the length of a piston. Instead, an electric motor can be used to extend a telescoping member that lifts the drawer. In this way, the drawer can be lifted to substantially any desired elevation.

One specific example of the many ways of coupling the electric motor to the drawer or file hangers is shown in FIG. 6*b*. The embodiment of FIG. 6*b* is presented by way of illustration only, and the electric motor embodiments should not be limited thereto. In FIG. 6*b*, an electric motor 150 is positioned within filing cabinet 110. In this example, electric motor 150 is located within drawer 114, although in other embodiments, it maybe positioned within or on the frame or another portion of filing cabinet 110.

Drawer 114 has a vertically extensible member 152 that is extended vertically in preparation for lifting file hangers 122. Member 152 has a pulley 154 at the top end thereof, which represents the highest elevation to which file hangers 122 can be lifted in this example. Drawer 114 also has another pulley 156. A cable 158 extends from a rotatable shaft of motor 150, through pulleys 156 and 154, and connects to file hangers 122 as shown in FIG. 6*b*. When file hangers 122 is to be lifted, drawer 114 is opened such that the file hangers clear frame 112. Member 152 is then automatically or manually extended vertically to its position shown in FIG. 6*b* and locked in place. As member 152 is lifted, cable 158 unwraps from a spindle 160 connected to motor 150.

Upon actuation of motor 150, cable 158 is would onto spindle 160 and experienced motion as shown at arrow 162. This motion of cable 158 results in a lifting motion of file hangers 122. At the selected or default elevation, the electric motor 150 automatically or manually shuts off. The file hangers 122 can then be locked in place, either by electric motor 150, which can resist unwinding of cable 158 from spindle 160, or by other mechanical means. In order to lower file hangers 122 to a position within drawer 114, electric motor 160 reverses the direction of cable 158. Alternatively, the drawer can be lowered by manually or automatically lowering member 154.

4. Spring-activated Structures

Figure 6C:
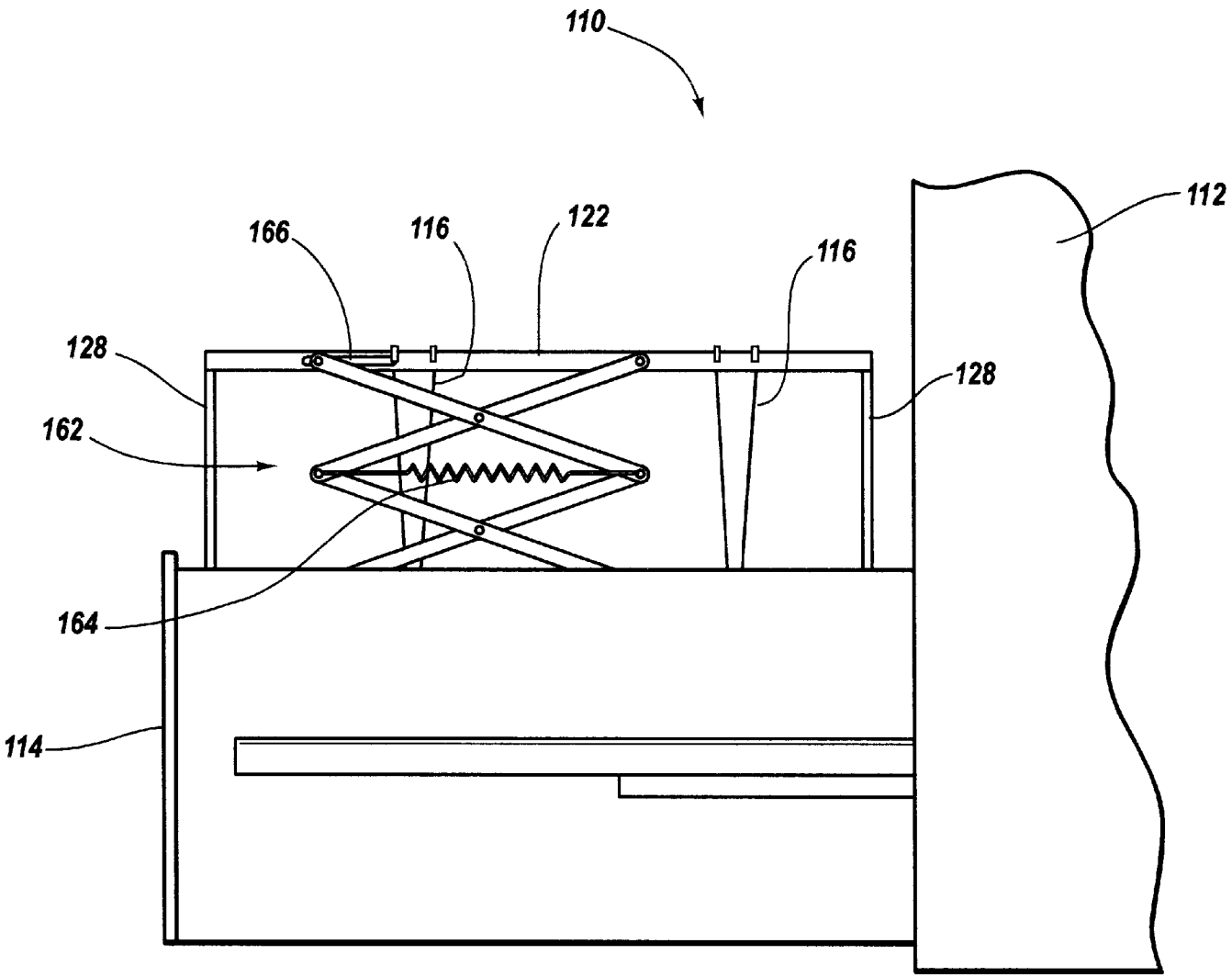
FIG. 6*c* is a side elevation view of a spring and a scissors assembly lifting a file hanger according to an embodiment of the invention.

In another embodiment, the drawers are raised and lowered with the assistance of spring-activated structures or, spring means for lifting the drawer or file hangers. FIG. 6*c* illustrates an example of a spring-activated structure 162 included in filing cabinet 110 to exert force on file hangers 122 that tends to raise the file hangers. The spring-activated structure 162 of FIG. 6*c* has a scissors configuration. When file hangers 122 are lowered into drawer 114, spring 164 experiences a tensile force. Thus, when file hangers 122 are disengaged from drawer 114, the tensile force of spring 164 and the potential energy stored in the spring result in an upward-directed force and vertical motion of file hangers. A coupling 166 on file hangers 122 with one degree of translational freedom and a similar coupling (not shown) on drawer 114 permits scissors assembly 162 to freely move when the file hangers are lifted and lowered. FIG. 6*c* also illustrates vertical members 128 associated with file hangers 122 that guide the file hangers when they are lifted.

The scissors assembly 162 of FIG. 6*c* can alternatively be used in combination with a pneumatic piston or another device that applies force thereto, rather than using the spring. The scissors assembly 162 can enable a piston to move a drawer a distance that is greater than the effective length of the piston.

In other embodiments, a spring can be included in the filing cabinet such that when the drawer is lowered and engaged with the drawer-opening assembly, the spring experiences a compressive force. This compressive force can be used to assist in raising and lowering the drawer.

One benefit of using springs is that they do not require an external energy supply, thereby reducing the complexity of the filing cabinet. Like most pneumatic pistons, the maximum force that can be exerted by springs is fixed, so that if the drawer is heavier than this force, the user may need to assist in lifting the drawer. Similarly, if the drawer is lighter than this force, the user may need to assist in lowering the drawer.

When using any of the structures disclosed herein that correspond to the means for lifting, particularly the pneumatic pistons and the spring-activated structures, it can be useful to include a device that acts as a shock absorber or a dashpot to slow the rate at which the drawer would otherwise fall from its raised position.

5. Other Considerations

In the case of bottom drawers, regardless of the means for lifting the drawer that is employed, a pneumatic piston can be attached to the underside of the drawer to limit the rate at which the drawer can be lowered. This optional feature can advantageously facilitate drawer movement by preventing the user from having to manually sustain as much of the weight of the drawer while it is lowered as might otherwise be required.

In embodiments where a hydraulic or pneumatic piston is attached to the underside of a bottom drawer, whether for purposes of lifting the drawer, slowing the rate by which it can be lowered, or both, the piston may need to be pivotally attached to the drawer, as illustrated in FIG. 6*a*, to allow the drawer to be opened and closed with respect to the frame.

While not a necessary feature of the various designs encompassed by the invention, it can be desirable to select a design that can be easily applied to filing cabinets that have conventional configurations. For example, many of the embodiments of the invention can be incorporated in otherwise conventional filing cabinets while requiring only minimal alterations to drawers, the filing cabinet frame, the drawer-opening assemblies, and the file hangers. However, there are other available designs within the scope of the invention that require more substantial alteration to conventional filing cabinet configurations. For example, the means for lifting the drawer may include a counterweight that is mechanically coupled with the drawer such that the drawer is lifted as the counterweight is lowered.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed and desired to be secured by United States Letters Patent is:

1. A filing cabinet for lifting contents of a drawer to a position that is accessible by a user, the filing cabinet comprising:

a frame;

a plurality of drawers, including a bottom drawer and another drawer that is immediately superior with respect to the bottom drawer;

a drawer-opening assembly connected to the frame and to the bottom drawer, the drawer-opening assembly allowing the drawer to be selectively moved to an open position and to a closed position with respect to the frame; and at least one piston connected to the drawer for lifting the drawer when the drawer has been moved to the open position, and while the immediately superior drawer is in a closed position, the at least one piston having:

a first end connected to the drawer; and a second end that is in contact with a floor that supports the filing cabinet when the at least one piston is used to lift the drawer.

2. A filing cabinet as recited in claim 1, wherein the at least one piston comprises a pneumatic piston connected to an underside of the drawer for limiting the rate by which the drawer can be lowered after the drawer has been lifted.

3. A filing cabinet as recited in claim 1, wherein the at least one piston operates by using energy that has been stored as potential energy in the at least one piston.

4. A filing cabinet as recited in claim 1, wherein the at least one piston operates by using external energy.

5. A filing cabinet as recited in claim 1, further comprising means for constraining the drawer to substantially vertical motion as the drawer is lifted.

6. A filing cabinet for lifting contents of a drawer to a position that is accessible by a user, the filing cabinet comprising:

a frame;

a plurality of drawers, including a bottom drawer and another drawer that is immediately superior with respect to the bottom drawer;

a drawer-opening assembly connected to the frame and to the bottom drawer, the drawer-opening assembly allowing the drawer to be selectively moved to an open position and to a closed position with respect to the frame; and a pneumatic piston connected to the drawer for lifting the drawer when the drawer has been moved to the open position, and while the immediately superior drawer is in a closed position, and for limiting the rate by which the drawer can be lowered after the drawer has been lifted.

7. A filing cabinet as recited in claim 6, wherein the at least one piston has a first end connected to the drawer and a second end that is in contact, when the at least one piston is used to lift the drawer, with a floor that supports the filing cabinet.

8. A filing cabinet as recited in claim 6, further comprising means for constraining the drawer to substantially vertical motion as the drawer is lifted.

* * * * *